US010947765B2

(12) United States Patent
Wu et al.

(10) Patent No.: US 10,947,765 B2
(45) Date of Patent: Mar. 16, 2021

(54) ASSISTING DAMPER, DAMPING ASSEMBLY AND COVER PLATE DEVICE

(71) Applicants: JIANGSU JIKAIZHONG TECHNOLOGY CO., LTD, Zhenjiang (CN); SUZHOU JIKAIZHONG ELECTRONIC TECHNOLOGY CO., LTD, Suzhou (CN)

(72) Inventors: Koujun Wu, Zhenjiang (CN); Baozhong Sun, Zhenjiang (CN)

(73) Assignee: JIANGSU JIKAIZHONG TECHNOLOGY CO., LTD, Zhenjiang (CN)

( * ) Notice: Subject to any disclaimer, the term of this patent is extended or adjusted under 35 U.S.C. 154(b) by 441 days.

(21) Appl. No.: 16/083,151

(22) PCT Filed: Dec. 15, 2017

(86) PCT No.: PCT/CN2017/116358
§ 371 (c)(1),
(2) Date: Sep. 7, 2018

(87) PCT Pub. No.: WO2018/233243
PCT Pub. Date: Dec. 27, 2018

(65) Prior Publication Data

US 2020/0300015 A1 Sep. 24, 2020

(30) Foreign Application Priority Data

Jun. 19, 2017 (CN) ..... 201720715088.4
Aug. 18, 2017 (CN) ..... 201710712932.2

(51) Int. Cl.
*E05F 3/20* (2006.01)
*D06F 39/14* (2006.01)
(Continued)

(52) U.S. Cl.
CPC ..... *E05F 3/20* (2013.01); *D06F 39/14* (2013.01); *E05F 3/10* (2013.01); *E05F 3/14* (2013.01);
(Continued)

(58) Field of Classification Search
CPC ..... E05F 3/20; E05F 3/14; E05F 3/104; E05F 5/02; E05F 3/10; E05F 3/00; E05F 5/08;
(Continued)

(56) References Cited

U.S. PATENT DOCUMENTS 5,901,412 A * 5/1999 Jentsch ..... E05F 3/104 16/53
6,464,052 B1 * 10/2002 Hsiao ..... E05F 3/14 188/290
(Continued)

FOREIGN PATENT DOCUMENTS

CN 102587778 A * 7/2012

*Primary Examiner* — William L Miller
(74) *Attorney, Agent, or Firm* — CBM Patent Consulting, LLC

(57) ABSTRACT

A cover plate device comprises a cover plate, a support plate and the damping assembly, wherein the cover plate is located at the upper part of the support plate, the damping assembly is provided on one side edge of the cover plate, and the assisting damper and a rotating damper are respectively connected with a support shaft on the support plate, so that the cover plate is rotatably connected with the support plate. The assisting damper comprises a shell I, a pin roll, a driving shaft, a driven shaft and a spring assembly, wherein a damper working chamber is arranged in the shell I; the driving shaft, the driven shaft and the spring assembly are all located in the damper working chamber; and when the driving shaft rotates, the driven shaft is driven to translate along the length direction of the damper working chamber.

11 Claims, 11 Drawing Sheets

(51) Int. Cl.
*E05F 3/14* (2006.01)
*E05F 5/02* (2006.01)
*E05F 3/10* (2006.01)

(52) U.S. Cl.
CPC ..... *E05F 5/02* (2013.01); *E05Y 2900/312* (2013.01); *Y10T 16/2771* (2015.01)

(58) Field of Classification Search
CPC ..... E05Y 2900/312; Y10T 16/2771; Y10T 16/304; Y10T 16/625; Y10T 16/5387; D06F 39/14; F16F 9/19; F16F 13/007
USPC ..... 16/54, 50, 85, 303; 68/196; 312/228, 312/326; 188/290
See application file for complete search history.

(56) References Cited

U.S. PATENT DOCUMENTS 6,913,252 B2 * 7/2005 Hayashi ..... F16F 1/127 188/381
8,875,345 B2 * 11/2014 Miglioranzo ..... E05F 3/12 16/54
2001/0004776 A1 * 6/2001 Fujita ..... A47K 13/12 4/236
2009/0188077 A1 * 7/2009 Lin ..... H04M 1/0216 16/273
2009/0188080 A1 * 7/2009 Lin ..... H04M 1/0216 16/299
2020/0063327 A1 * 2/2020 Byun ..... E05F 3/20
2021/0010191 A1 * 1/2021 Ahamad ..... E05F 3/104

* cited by examiner

ASSISTING DAMPER, DAMPING ASSEMBLY AND COVER PLATE DEVICE

TECHNICAL FIELD

The present invention relates to the field of dampers, in particular to an assisting damper, a damping assembly and a cover plate device.

BACKGROUND ART

Existing paths for realizing retarded descending of a cover plate are generally arranging a rotating damper at each of the left end and the right end of the cover plate, but the structure characteristics of the existing rotating dampers determine that since there is no retarded descending function during descending, the descending speed of the cover plate is relatively high, hands or arms below the cover plate are easy to be splinted, and thus customer experience is poor.

SUMMARY OF THE INVENTION

Based on this, it is necessary to provide an assisting damper with a small-angle retarded descending function, a damping assembly and a cover plate device.

The assisting damper comprises a shell I, a pin roll, a driving shaft, a driven shaft and a spring assembly, wherein a damper working chamber is arranged in the shell I, one end of the pin roll penetrates out of the head end of the damper working chamber, the other end is fixed with one end of the driving shaft, the other end of the driving shaft is in contact with one end of the driven shaft, spiral cam structures matched with each other are respectively provided on the contact surfaces of the driving shaft and the driven shaft, the other end of the driven shaft is connected with one end of the spring assembly, the shape of a base of the driven shaft is matched with the shape of the longitudinal section of the damper working chamber, the base does not rotate in the damper working chamber, the other end of the spring assembly is in contact with the tail end, opposite to the head end, of the damper working chamber; the driving shaft, the driven shaft and the spring assembly are all located in the damper working chamber, and when the driving shaft rotates, the driven shaft is driven to translate along the length direction of the damper working chamber.

According to the technical solution, as the spiral cam structures matched with each other are respectively provided on the contact surfaces of the driving shaft and the driven shaft, when the driving shaft rotates, the driven shaft is driven to move along the length direction of the damper working chamber; as the spring assembly is connected to one end of the driven shaft, and the elastic force of the spring assembly is applied to the driven shaft all the time, when the assisting damper is applied to the cover plate, in the descending process of the cover plate, the spring assembly provides a torque, opposite to the moving direction of the cover plate, for the cover plate, so as to achieve a retarded descending function on the cover plate in the descending process and prevent the cover plate from descending rapidly to pinch the user, and therefore, the safety factor is relatively high; meanwhile, when the cover plate is up-lifted, assistance may be provided, so as to reduce strength needed by the user in up-lifting.

In one embodiment, a tail plug is provided at the tail end of the damper working chamber, and one end, close to the spring assembly, of the tail plug is in contact with the spring assembly.

According to the technical solution, due to the arrangement of the tail plug, the pin roll, the driving shaft, the driven shaft and the spring assembly are placed in the damper working chamber from the tail end, and then the tail plug is mounted at the tail end, and therefore, the bearing strength is greater.

In one embodiment, a shaft sleeve and an end cover are provided at the head end of the damper working chamber, one end of the shaft sleeve is located on the inner wall of the head end of the damper working chamber, the other end is located outside the head end, the end cover is located on the outer wall of the head end of the damper working chamber, the inner wall of the end cover is in matched fix with the outer wall of the part, extending out of the head end, of the shaft sleeve, and one end of the pin roll sequentially passes through the shaft sleeve and the end cover and then extends out of the shell I.

According to the technical solution, as the shaft sleeve and the end cover are provided at the head end, the end cover may be mounted at the head end after the shaft sleeve, the driving shaft, the driven shaft and the spring assembly are mounted in the damper working chamber, and then the installation of the assisting damper is completed.

In one embodiment, the spring assembly comprises a first spring and a second spring, the first spring and the second spring are sequentially arranged, the outer diameter of the first spring is the same as the outer diameter of the second spring, one end of the first spring is mounted on the driven shaft, the other end is in contact with one end of the second spring, and the other end of the second spring is in contact with the inner wall of the tail plug.

According to the technical solution, due to the arrangement of the first spring and the second spring, elasticity change of the spring assembly is gentler, so that the minimum use angle of the assisting damper is smaller.

In one embodiment, the driving shaft comprises a first helicoid and a second helicoid, a round hole is formed in the center of one end, far away from the pin roll, of the driving shaft, and the first helicoid and the second helicoid are respectively located at the periphery of the round hole;

the driven shaft comprises a base, a round shaft, a third helicoid and a fourth helicoid, the round shaft is provided at the center of the base, the third helicoid and the fourth helicoid are respectively located at the periphery of the round shaft, the round shaft is matched with the round hole, and the third helicoid and the fourth helicoid are mutually matched with the first helicoid and the second helicoid.

According to the technical solution, due to arrangement of a flat site I and a flat site groove, fixing of the pin roll and the driving shaft is firmer; in addition, as the round hole and the round shaft are provided, and the round shaft is inserted into the round hole, when the driving shaft rotates, because the shape of the base of the driven shaft is matched with the longitudinal section of the damper working chamber, the base of the driven shaft cannot rotate together with the driving shaft, and under the pushing of the first helicoid and the second helicoid, when the driving shaft rotates, the driven shaft is driven to translate along the length direction of the damper working chamber.

In one embodiment, the spring assembly comprises a third spring and a fourth spring, the diameter of the third spring is greater than the diameter of the fourth spring, the spiral direction of the third spring is opposite to the spiral direction of the fourth spring, the third spring is mounted on the outer side of the driven shaft, and the fourth spring is mounted on the inner side of the driven shaft.

According to the technical solution, as the spiral directions of the third spring and the fourth spring are opposite, the situation that the springs cannot work because the two springs are intersected is avoided, and the use effect is better.

A damping assembly, comprising the assisting damper and the rotating damper used in match, and the assisting damper and the rotating damper are both mounted on the cover plate.

According to the technical solution, as the assisting damper and the rotating damper are both mounted on the cover plate, in the descending process of the cover plate, the assisting damper plays a role of assisting in ascending, so as to reduce the gravity of the cover plate and play a role of retarding descending.

In one embodiment, the rotating damper comprises a shell II, a rotating shaft mechanism, an upper cover, a sealing member, two vanes and two choke plates, wherein the shell II comprises a containing cavity, the rotating shaft mechanism is arranged in the containing cavity, the rotating shaft mechanism and the upper cover are sealed by the sealing member, a pair of rib sites are axially and symmetrically provided on the inner wall of the containing cavity, the two vanes are axially and symmetrically provided on the rotating shaft mechanism, the choke plates are provided in the vanes, the vanes are arranged in match with the rib sites, a viscous fluid is filled in a buffer space of the containing cavity, the rotating shaft mechanism comprises a rotating shaft and a flat site II, the flat site II is connected with one end of the rotating shaft, the flat site II is located outside the shell II, and the cross section of the rotating shaft is formed by two segments of parabolas and two recesses.

According to the technical solution, as the cross section of the outer circle of the rotating shaft is of a shape formed by two segments of parabolas and two recesses, when the rotating shaft rotates in the front half stroke of descending of the cover plate, gaps between the rotating shaft and the rib sites in the inner wall of the containing cavity are relatively large, and therefore, the torsion value of the rotating damper in the front half stroke is reduced, the damping force is weak, and the cover plate descends to the horizontal state from the vertical state in a retarded way smoothly. Wherein the buffer space is the residual space of the containing cavity after the rotating shaft, the vanes and the choke plates are placed into the containing cavity.

In one embodiment, the rotating shaft mechanism further comprises two bosses, the two bosses are axially and symmetrically provided on the rotating shaft, the vanes are mounted on the bosses, grooves are formed in the middles of the vanes, and the choke plates are arranged in the grooves; and the viscous fluid is silicone oil.

In one embodiment, the volume of the viscous fluid occupies 90-97% of the volume of the buffer space of the containing cavity.

According to the technical solution, because the volume of the viscous fluid occupies 90% or above of the volume of the buffer space, in the descending process of the rotating damper, the silicone oil, instead of air, can enter a low-pressure chamber in the first time, so that the minimum use angle of the rotating damper is smaller, and the adaptability is stronger.

A cover plate device, comprising a cover plate, a support plate and the abovementioned damping assembly, wherein the cover plate is located at the upper part of the support plate, the damping assembly is provided on one side edge of the cover plate, and the assisting damper and the rotating damper are respectively connected with a support shaft on the support plate, so that the cover plate is rotatably connected with the support plate.

According to the technical solution, as the assisting damper and the rotating damper are respectively mounted on the support shaft of the support plate, when the cover plate descends for closing, both the assisting damper and the rotating damper can play the role of retarding descending, so as to prevent injury to people, and the safety is higher.

Beneficial effects: compared with the prior art, the present invention has the following advantages: due to the arrangement of the assisting damper, when the damping assembly is applied to the cover plate, when the cover plate descending for closing, the damping assembly can play a role of retarding descending, so as to prevent the cover plate from descending rapidly to splint the user, and therefore, the safety factor is relatively high; meanwhile, when the cover plate is up-lifted, assistance can be provided, so as to reduce strength needed by the user in up-lifting.

DETAILED DESCRIPTION OF THE INVENTION

Detailed description will be made to preferred embodiments of the present invention in the following in combination with the drawings, so that advantages and characteristics of the present invention may be more easily understood by technicians in the art, and thus more clearly and definitely defining the protective scope of the present invention.

Embodiment 1

Figure 1:
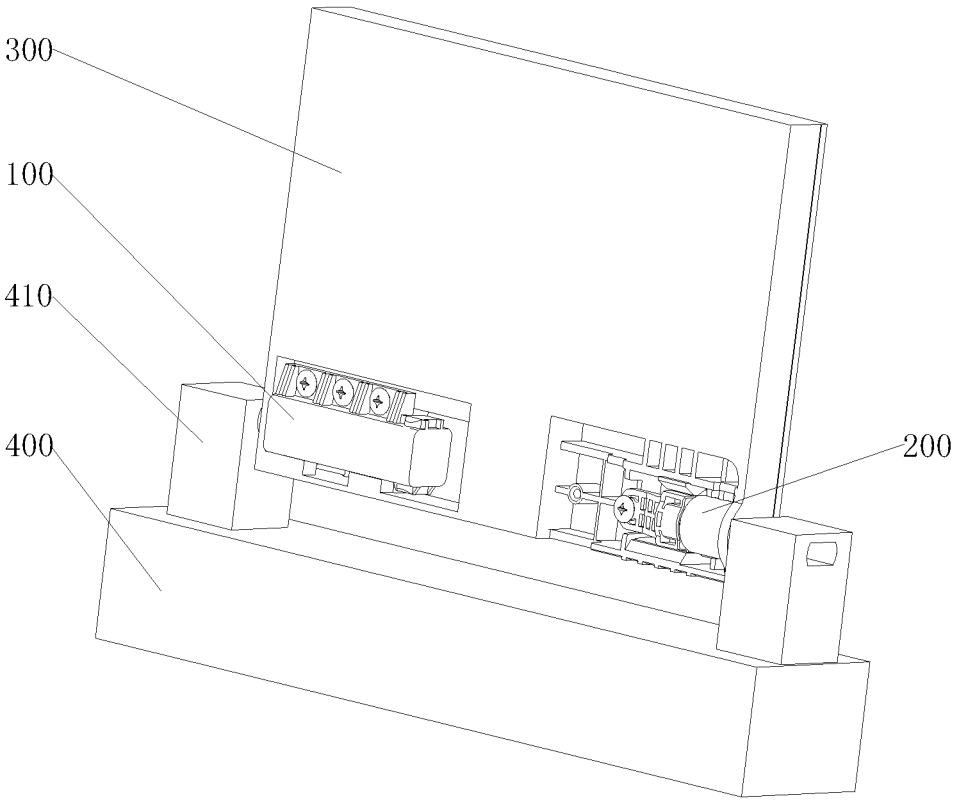
FIG. 1 is a structural schematic diagram of a cover plate device of embodiment 1.
Figure 2:
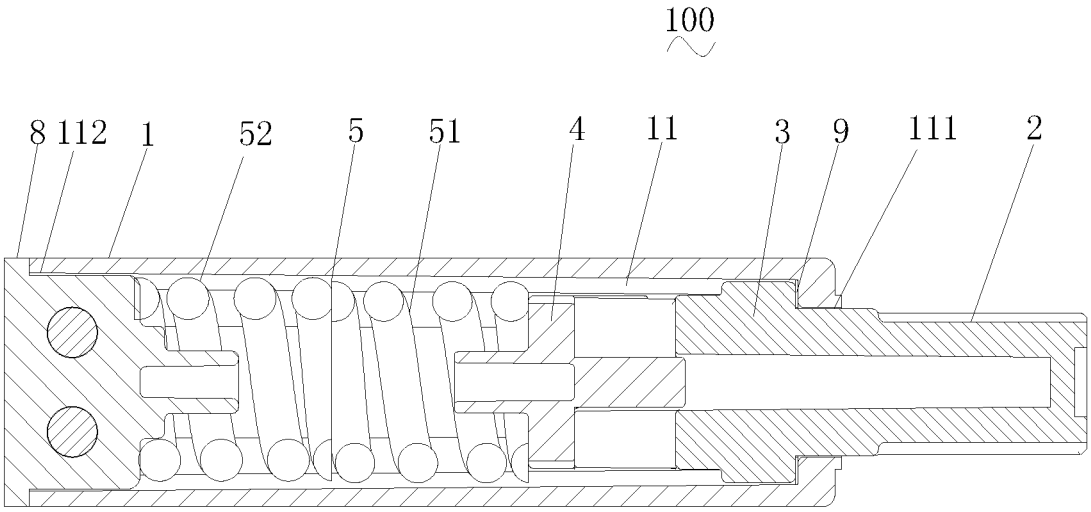
FIG. 2 is a half-section structural schematic diagram of an assisting damper of embodiment 1.
Figure 3:
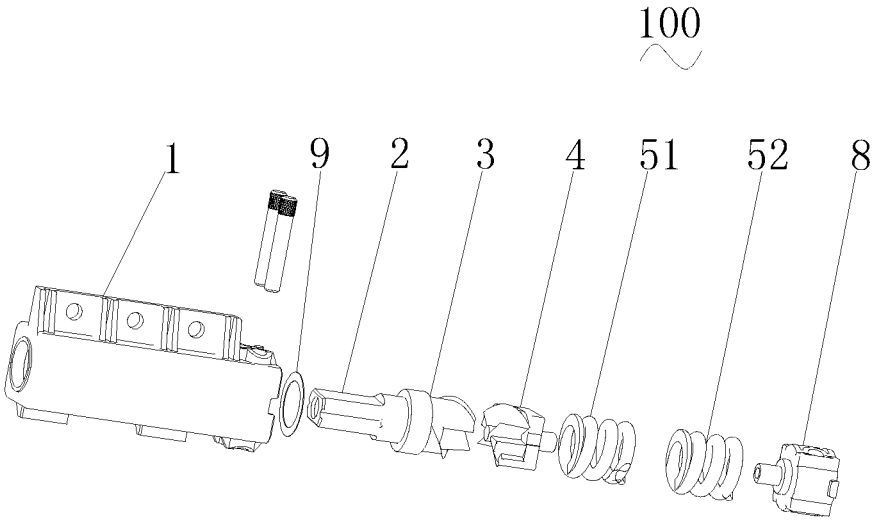
FIG. 3 is an exploded view of the assisting damper of embodiment 1.
Figure 4:
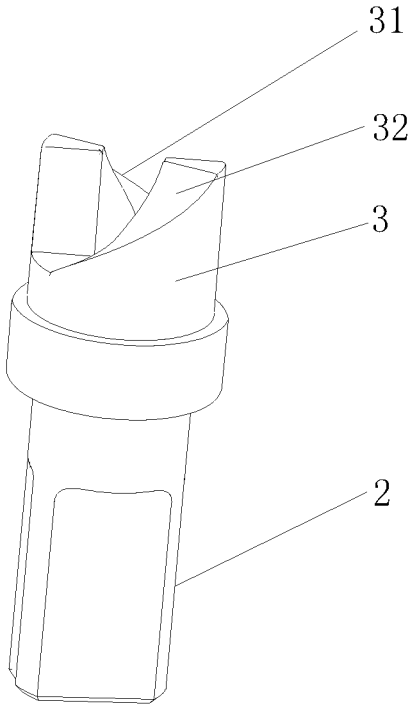
FIG. 4 is a structural schematic diagram of a driving shaft and a pin roll of embodiment 1.
Figure 5:
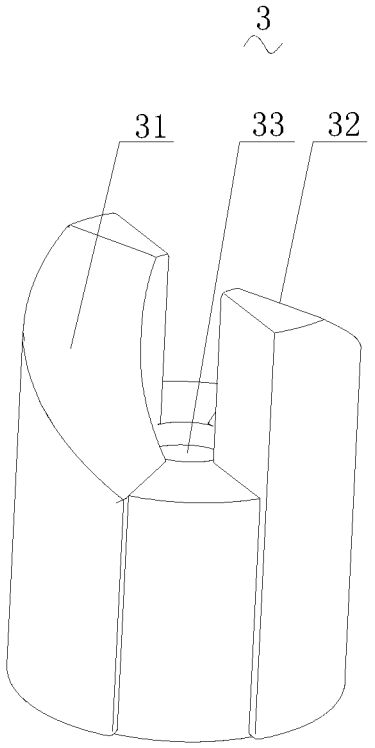
FIG. 5 is a structural schematic diagram of the driving shaft of embodiment 1.
Figure 6:
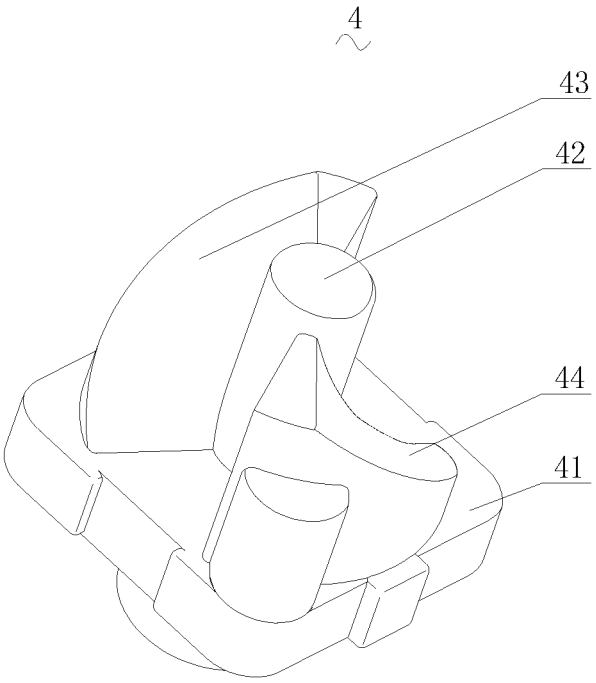
FIG. 6 is a structural schematic diagram of a driven shaft of embodiment 1.
Figure 7:
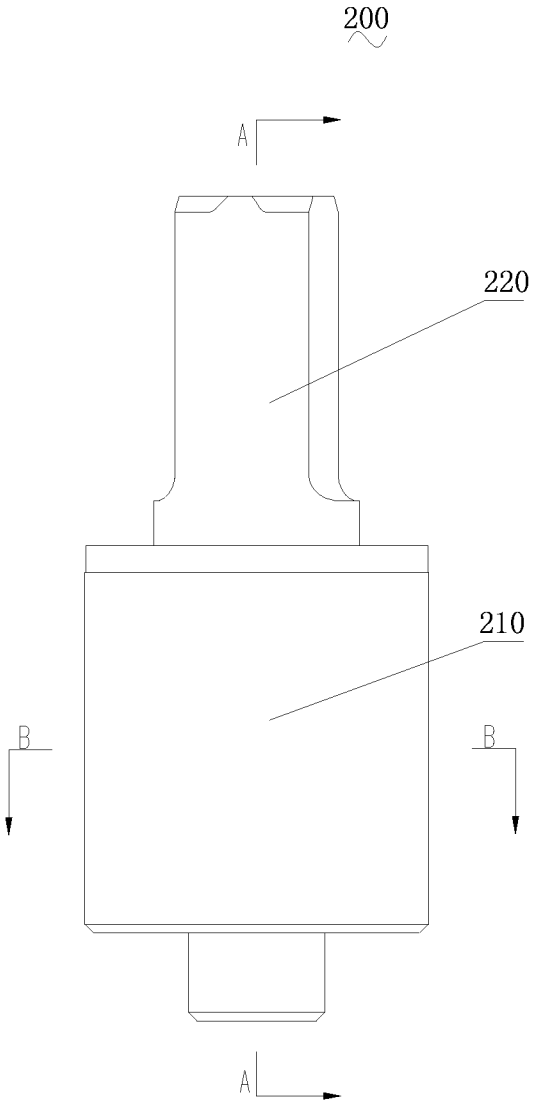
FIG. 7 is a frontal view of a rotating damper of the present invention.
Figure 8:
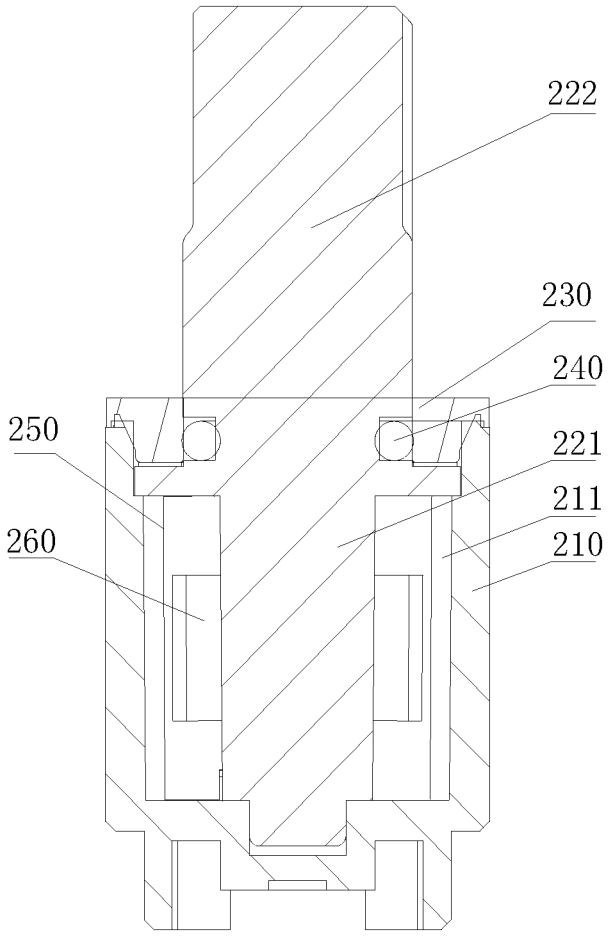
FIG. 8 is a sectional view of FIG. 7 along the line A-A.
Figure 9:
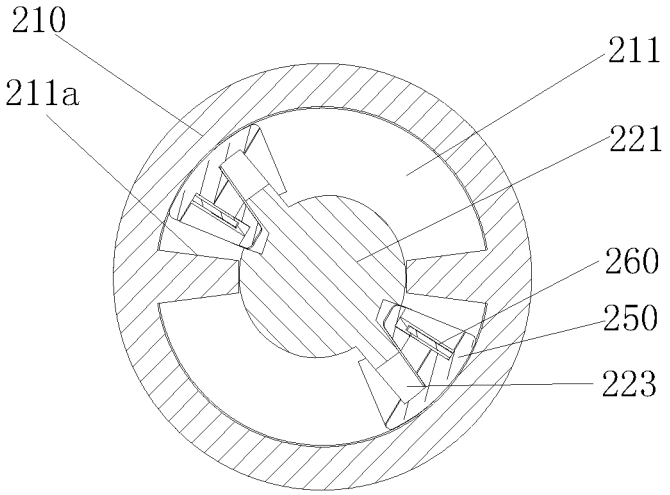
FIG. 9 is a sectional view of FIG. 7 along the line B-B.
Figure 10:
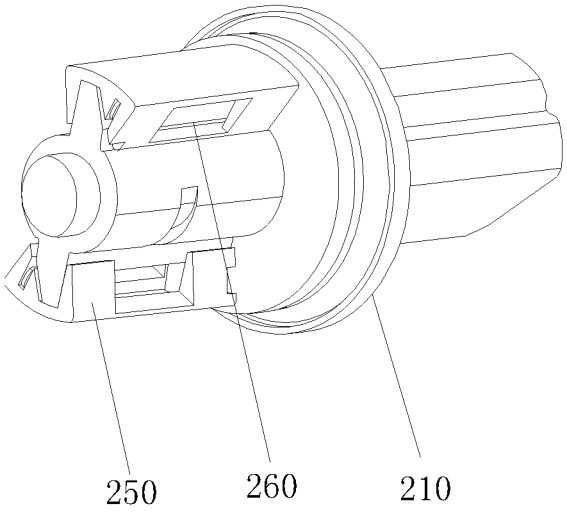
FIG. 10 is mounting structural schematic diagrams of a rotating shaft mechanism, vanes and choke plates of the rotating damper of the present invention.
Figure 11:
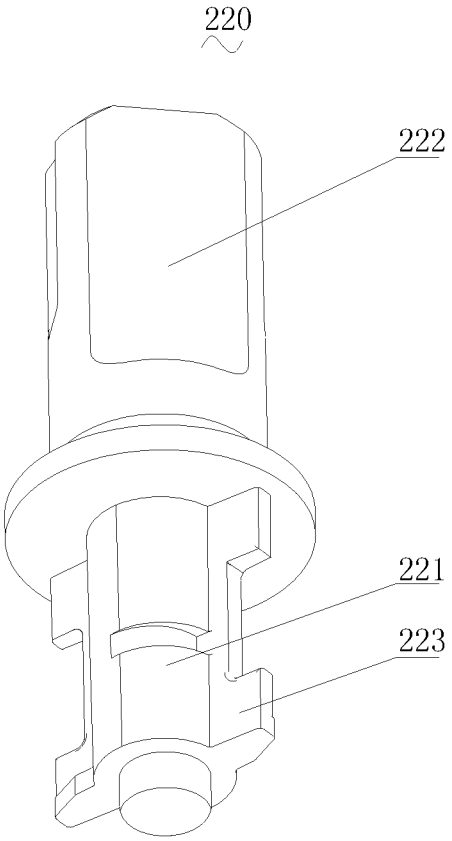
FIG. 11 is a stereogram of the rotating shaft mechanism of the rotating damper of the present invention.
Figure 12:
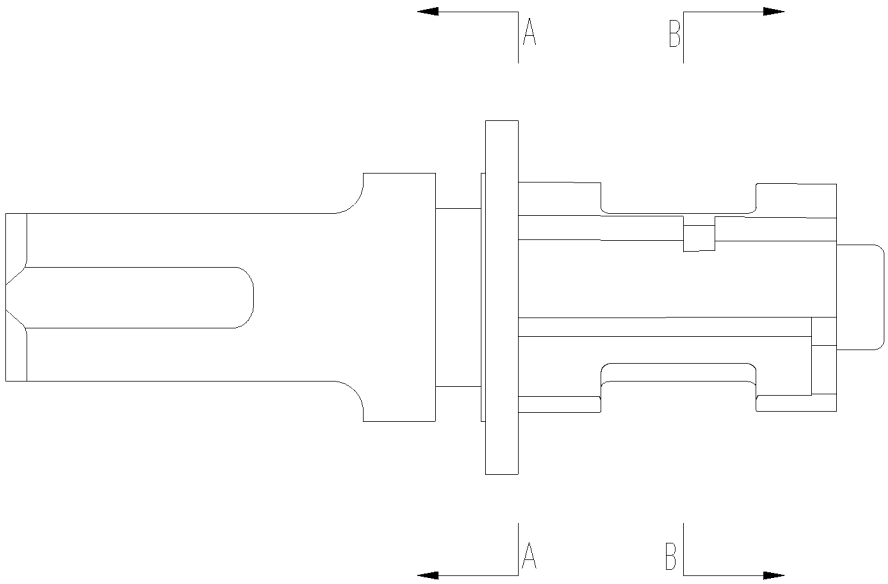
FIG. 12 is a frontal view of the rotating shaft mechanism of the rotating damper of the present invention.
Figure 13:
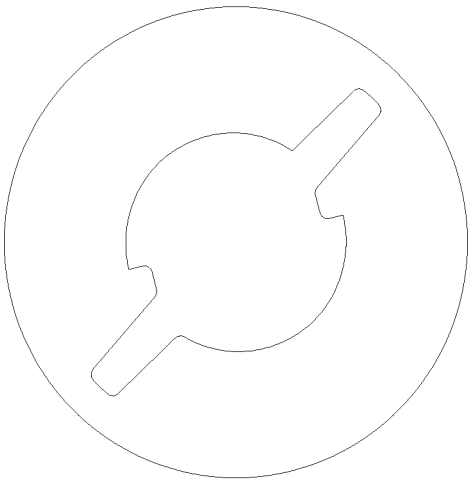
FIG. 13 is a sectional view of FIG. 12 along the line A-A.
Figure 14:
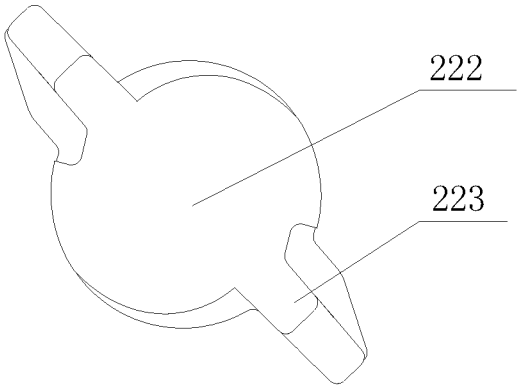
FIG. 14 is a sectional view of FIG. 12 along the line B-B.

Referring to FIG. 1, a cover plate device is provided, comprising a cover plate 300, a support plate 400 and a damping assembly, wherein the cover plate 300 is located at the upper part of the support plate 400, the damping assembly is provided on one side edge of the cover plate 300, and an assisting damper 100 and a rotating damper 200 are respectively connected with a support shaft 410 on the support plate 400, so that the cover plate 300 is rotatably connected with the support plate 400.

The damping assembly comprises the assisting damper 100 and the rotating damper 200 used in match. The assisting damper 100 and the rotating damper 200 may be respectively located at two ends of one side edge of the cover plate 300, or one damping assembly is arranged at each of two ends of the cover plate 300, in the present embodiment, one assisting damper 100 and one rotating damper 200 are respectively arranged at two ends of one side edge of the cover plate 300.

Referring to FIGS. 2-6, in the present embodiment, the assisting damper 100 comprises a shell I 1, a pin roll 2, a driving shaft 3, a driven shaft 4, a spring assembly 5, a tail plug 6 and a gasket 9, wherein a damper working chamber 11 is arranged in the shell I 1, one end of the pin roll 2 penetrates out of the head end 111 of the damper working chamber 11, the other end is fixed with one end of the driving shaft 3, the other end of the driving shaft 3 is in contact with one end of the driven shaft 4, spiral cam structures matched with each other are respectively provided on the contact surfaces of the driving shaft 3 and the driven shaft 4, the other end of the driven shaft 4 is connected with one end of the spring assembly 5; the other end of the spring assembly 5 is in contact with the tail end 112, opposite to the head end, of the damper working chamber 11; the shape of a base 41 of the driven shaft 4 is matched with the shape of the longitudinal section of the damper working chamber 11, and the base 41 does not rotate in the damper working chamber 11. The tail plug 6 is located at the tail end 112 of the damper working chamber 11. One end of the pin roll 2 is sleeved with a gasket 9, and then penetrates out of the head end 111 from the damper working chamber 11, so that the gasket 9 is located between the pin roll 2 and the inner wall of the damper working chamber 11.

The driving shaft 3, the driven shaft 4 and the spring assembly 5 are all located in the damper working chamber 11, and when the driving shaft 3 rotates, the driven shaft 4 is driven to translate along the length direction of the damper working chamber 11. The shape of the base 41 may be square, triangle, pentagon or other polygons, the shape of the longitudinal section of the damper working chamber 11 is matched with the shape of the base 41, and in the present embodiment, the shapes of the base 41 and the longitudinal section of the damper working chamber 11 are both square. When the driven shaft 4 is placed in the damper working chamber 11, the base 41 is matched and locked with the damper working chamber 11, so that the base 41 cannot rotate along with rotation of the driving shaft 3, and when the driving shaft 3 rotates, the driven shaft 4 is driven to translate along the length direction of the damper working chamber 11.

The pin roll 2 and the driving shaft 3 are integrated into one to serve as one part, the driving shaft 3 comprises a first helicoid 31 and a second helicoid 32; a round hole 33 is formed in the center, far away from the pin roll 2, of the driving shaft 3; and the first helicoid 31 and the second helicoid 32 are respectively located at the periphery of the round hole 33.

The driven shaft 4 also comprises a round shaft 42, a third helicoid 43 and a fourth helicoid 44, the round shaft 42 is provided at the center of the base 41, the third helicoid 43 and the fourth helicoid 44 are respectively located at the periphery of the round shaft 42, the round shaft 42 is matched with the round hole 33, and the third helicoid 43 and the fourth helicoid 44 are mutually matched with the first helicoid 31 and the second helicoid 32.

The spring assembly 5 comprises a first spring 51 and a second spring 52, the first spring 51 and the second spring 52 are sequentially arranged, the outer diameter of the first spring 51 is the same as the outer diameter of the second spring 52, one end of the first spring 51 is mounted on the driven shaft 4, the other end is in contact with one end of the second spring 52, and the other end of the second spring 52 is in contact with the inner wall of the tail plug 6.

The mounting process of the assisting damper 100 is as follows: one end of the pin roll 2 is sleeved with the gasket 9 and then penetrates out of the head end from the damper working chamber 11, the other end of the pin roll 2 is mounted in a flat site groove 34 of the driving shaft 3, then the driven shaft 4 is placed in the damper working chamber 11, the round shaft 42 of the driven shaft 4 is inserted into the round hole 33 of the driving shaft 3, the third helicoid 43 and the fourth helicoid 44 are mutually matched with the first helicoid 31 and the second helicoid 32, and then the first spring 51, the second spring 52 and the tail plug 6 are sequentially arranged at one end, far away from the driving shaft 3, of the driven shaft 4, thus finishing mounting of the assisting damper.

Referring to FIGS. 7-14, the rotating damper 200 comprises a shell II 210, a rotating shaft mechanism 220, an upper cover 230, a sealing member 240, two vanes 250 and two choke plates 260, wherein the shell II 210 comprises a containing cavity 211, the rotating shaft mechanism 220 is arranged in the containing cavity 211, the rotating shaft mechanism 220 and the upper cover 230 are sealed by the sealing member 240, a pair of rib sites **211*a* are axially and symmetrically provided on the inner wall of the containing cavity 211; the rotating shaft mechanism 220 comprises a rotating shaft 221, a flat site II 222 and two bosses 223; the two bosses 223 are axially and symmetrically provided on the rotating shaft 221, the two vanes 250 are arranged on the bosses 223, grooves are formed in the middles of the vanes 250, and the choke plates 260 are arranged in the grooves; the vanes 250 are arranged in match with the rib sites 211*a*, the flat site II 222 is connected with one end of the rotating shaft 221, the flat site II 222 is located outside the shell II 210, and the cross section of the rotating shaft (221) is of a shape formed by two segments of parabolas and two recesses. In the present embodiment, the two segments of parabolas are set in a central symmetry way by taking the rotating center of the rotating shaft 221 as an axis, one end of one segment of parabola is connected with one boss 223, and the other end is connected with the recess. Preferably, the parameter equation of the parabola is y=sin x, and gaps between the rotating shaft 221 and rib sites 211*a* of the shell II 210** may be adjusted, so that descending of the cover plate is gentler. The two segments of parabolas also may be set in an asymmetric way.

Preferably, a viscous fluid is filled in the buffer space of the containing cavity 211, preferably, the viscous fluid is silicone oil, and the volume of the viscous fluid occupies 90-97% of the volume of the buffer space. In the present embodiment, the volume of the silicone oil occupies 90% of the volume of the buffer space. In use of the existing rotating dampers, due to the self characteristic requirements of technology and products, the interior of the rotating damper should not be completely full of silicone oil, generally, the volumes of the silicone oil occupying the volume of the buffer space are all lower than 90%, and because air exists in the rotating damper, when the rotating damper descends, air mass expands first at one sides of the vanes in the rotating damper, while air is compressed first at the other sides, instead of the situation that silicone oil enters the low-pressure chamber in the first time, and therefore, in use of the rotating damper, the phenomenon of poor small angle exists. In the present embodiment, because the volume of the viscous fluid occupies 90% or above of the volume of the buffer space, in the descending process of the rotating damper, the silicone oil, instead of the air, may enter the low-pressure chamber in the first time, so that the minimum use angle of the rotating damper is smaller, and the adaptability is stronger.

Because the vanes and the choke plates of the rotating damper cannot be well sealed like an oil cylinder with a sealing ring, the containing cavity being divided into two parts by the vanes originally is communicated actually, with the result that the torsion value of the rotating damper is only a torque value generated by friction force if the interior of the rotating damper is full of silicone oil, and therefore, in practical engineering application, the interior of the rotating damper should not be full of silicone oil; because a form of ultrasonic welding of the upper cover and the shell II is commonly adopted for the rotating damper, if the interior of the rotating damper is overfilled with the silicone oil, silicone oil overflows by being vibrated or compressed or being influenced by the siphon phenomenon in ultrasonic welding, and contaminates the welded position, causing insecure welding, and under the condition that the oil reserve is continuously increasing, the torsion value provided by the silicone oil with the same viscosity will be lowered, to sum up, the oil reserve should not exceed 90% in actual production. In order to solve the problem, a new technology is adopted to enable the volume of the silicone oil occupying the volume of the buffer space to reach 90-97%. The specific technological process is as follows: the rotating shaft 221 is inserted into the containing cavity 211 injected with silicone oil, the containing cavity 211 stands for over 12 hours, then the upper cover is welded with the shell II, and then the volume of the silicone oil inside may occupy 90-97% of the volume of the buffer space, so as to further improve the small angle performance of the rotating damper. Small angle refers to a minimum degree of angle of the rotating damper capable of realizing the retarded descending efficacy when the rotating damper descends.

The working principle of the rotating damper 200 is as follows: when the rotating shaft 221 rotates clockwise with a certain angle, pressure is raised due to reduction of volume in the containing cavity at one side, and partial vacuum is formed due to increase of volume in the containing cavity in the other side, so that the silicone oil flows from a high-pressure chamber to a low-pressure chamber; due to the blocking effect of the chock plates 260, damping moment generated by the rotating damper forms a proportional relation with the angular velocity of an output shaft in a certain scope, and the proportionality coefficient is mainly determined by the oil sealing strength of the chock plates, the better the oil is sealed, the greater the coefficient is. When the rotating shaft 221 rotates anticlockwise, in the front half stroke, a gap between the rotating shaft 221 and the shell II 210 is large, the damping moment is smaller, and in the rear half stroke, the gap between the rotating shaft 221 and the shell II 210 is smaller, and the damping moment is greater. When equipment needing to descend to the horizontal state from the vertical state in a retarded way, such as a cover plate of a washing machine, is mounted, resistance in the front half stroke is relatively small, so that the cover plate of the washing machine can descend in a retarded way in a relatively small use angle, and the descending speed in the front half stroke is promoted; the resistance in the rear half stroke is relatively great, so that the cover plate of the washing machine may be still gently covered on the washing machine, and therefore, loud noise made when the cover plate is closed is avoided, and customer experience is good.

The working principle of the cover plate is as follows: in the present embodiment, the assisting damper 100 and the rotating damper 200 are respectively provided at two ends of one side edge of the cover plate 300, one end of the pin roll 2 of the assisting damper 100 is mounted on a support shaft 410 of the support plate 400, a flat site II 222 of the rotating damper 200 is mounted on the other support shaft 410 of the support plate 400; when the cover plate 300 is opened or closed, the shell I 1 of the assisting damper 100 and the shell II 210 of the rotating damper 200 rotate along with movement of the cover plate 300; in the descending process of the cover plate, when the shell I rotates, the driven shaft 4 synchronously rotates along with the shell I 1; because neither the driving shaft 3 nor the driven rotate 4 can rotate, the driven shaft 4 translates in the damper working chamber 11; due to the arrangement of the spring assembly 5, the translation speed of the driven shaft 4 in the damper working chamber 11 may be retarded, an acting force opposite to the descending direction is provided for the cover plate 300, so that a retarded descending function is achieved for the cover plate 300; in addition, because the cross section of the rotating shaft 221 of the rotating damper 200 is two segments of parabolas, the retarded descending function is further improved.

Embodiment 2

Figure 15:
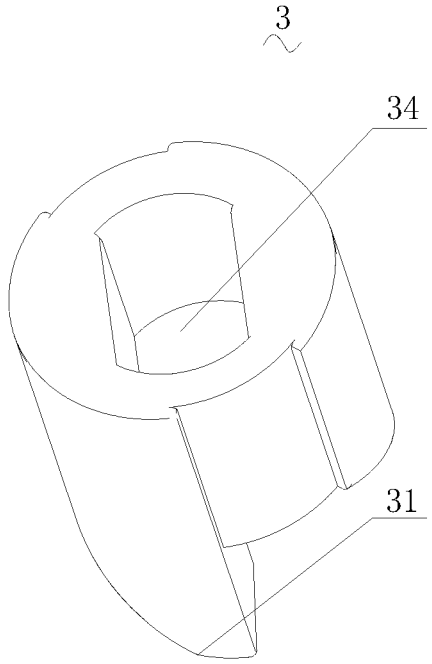
FIG. 15 is a structural schematic diagram II of a driving shaft of embodiment 2.
Figure 16:
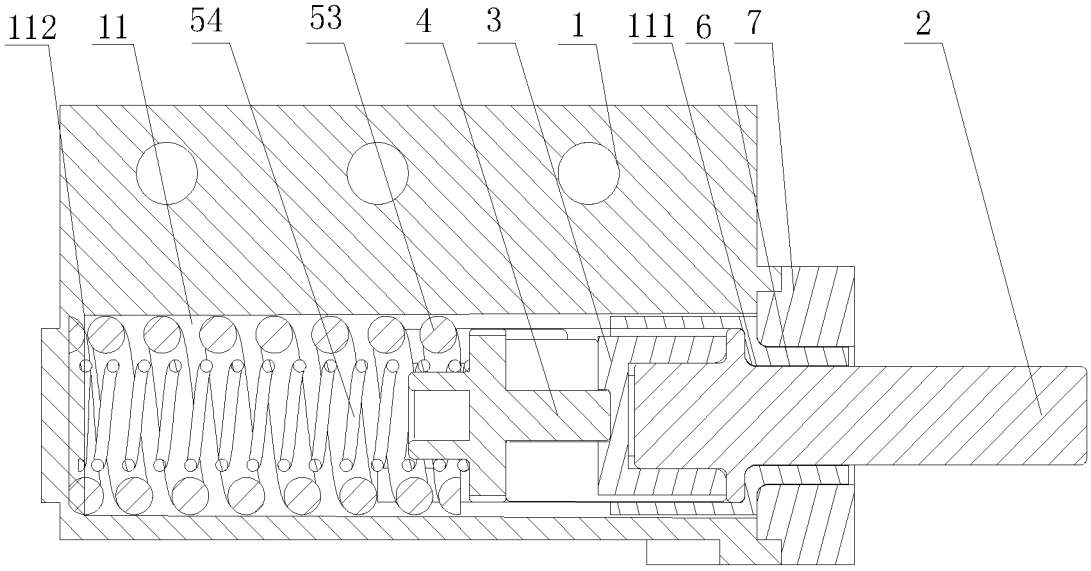
FIG. 16 is a half-section structural schematic diagram of an assisting damper of embodiment 2.
Figure 17:
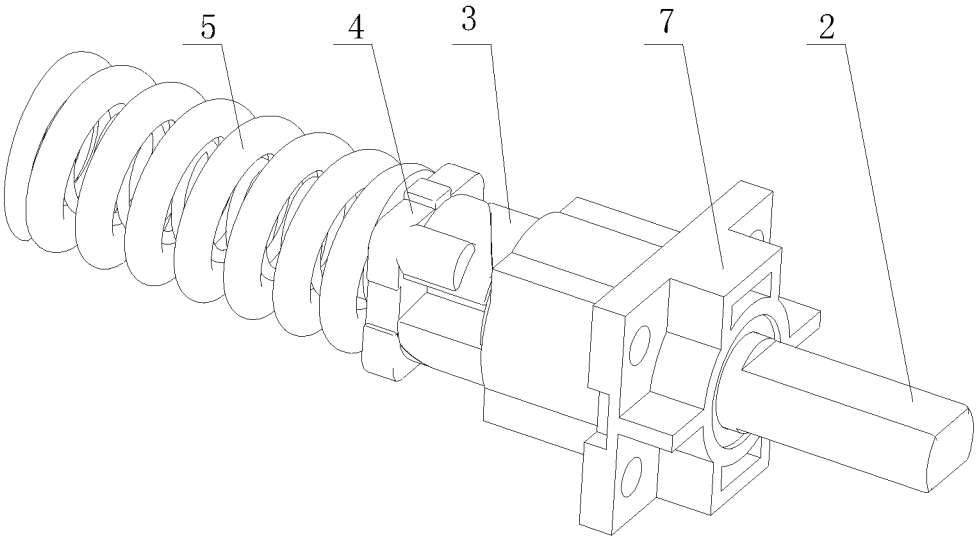
FIG. 17 is a structural schematic diagram of embodiment 2 after a shell I is removed.

Referring to FIGS. 15-17, a point of distinction from the embodiment 1 is that in the structure of the assisting damper 100, in the present embodiment, the tail plug 6 and the gasket 9 are not provided on the assisting damper 100, and all parts are mounted into the damper working chamber 11 from the head end. In the present embodiment, a shaft sleeve 7 and an end cover 8 are provided at the head end of the damper working chamber 11, one end of the shaft sleeve 7 is located on the inner wall of the head end of the damper working chamber 11, the other end is located outside the head end, the end cover 8 is located on the outer wall of the head end of the damper working chamber 11, the inner wall of the end cover 8 is in matched connection with the outer wall of the part, extending out of the head end 111, of the shaft sleeve 7, and one end of the pin roll 2 sequentially passes through the shaft sleeve 7 and the end cover 8 and then extends out of the shell I 1. One end of the pin roll 2 is set as the flat site I, the flat site groove 34 is formed in the center of one end of the driving shaft 3, and the flat site I is inserted into the flat site groove 34 and is fixed. The spring assembly 5 comprises a third spring 53 and a fourth spring 54, the diameter of the third spring 53 is greater than the diameter of the fourth spring 54, the spiral direction of the third spring 53 is opposite to the spiral direction of the fourth spring 54, the third spring 53 is mounted on the outer side of the driven shaft 4, the fourth spring 54 is mounted on the inner side of the driven shaft 4, and one end, far away from the driven shaft 4, of the spring assembly 5 is in contact with the tail end 112 of the damper working chamber 11, in the present embodiment, the tail end 112 is a sealed end integrally formed with the damper working chamber 11.

The mounting process of the assisting damper 100 is as follows: after the spring assembly 5 is mounted on one end, far away from the driving shaft 3, of the driven shaft 4, the driven shaft 4 and the spring assembly 5 are placed in the damper working chamber 11, and one end of the spring assembly 5 is in contact connection with the tail end; then the driving shaft 3 is also placed in the damper working chamber 11, the driving shaft 3 and the driven shaft 4 are placed in a matched way, one end of the pin roll 2 is inserted into the flat site groove 34 of the driving shaft 3, and the other end is sleeved with the shaft sleeve 7, and then is sleeved with the end cover 8 and fixed, thus completing the mounting process of the assisting damper 100.

Embodiment 3

The difference between the present embodiment and the embodiment 1 lies in that the volume of the silicone oil occupies 92% of the volume of the buffer space of the containing cavity 211.

Embodiment 4

The difference between the present embodiment and the embodiment 1 lies in that the volume of the silicone oil occupies 94% of the volume of the buffer space of the containing cavity 211.

Embodiment 5

The difference between the present embodiment and the embodiment 1 lies in that the volume of the silicone oil occupies 95% of the volume of the buffer space of the containing cavity 211.

Embodiment 6

The difference between the present embodiment and the embodiment 1 lies in that the volume of the silicone oil occupies 96% of the volume of the buffer space of the containing cavity 211.

Embodiment 7

The difference between the present embodiment and the embodiment 1 lies in that the volume of the silicone oil occupies 97% of the volume of the buffer space of the containing cavity 211.

Embodiment 8

The difference between the present embodiment and the embodiment 1 lies in that the volume of the silicone oil occupies 85% of the volume of the buffer space of the containing cavity 211.

Embodiment 9

The difference between the present embodiment and the embodiment 1 lies in that the volume of the silicone oil occupies 80% of the volume of the buffer space of the containing cavity 211.

Performance Test

1. Aiming at conditions of different silicone oil reserves, compare the use small angles of the rotating damper.

The experiment process is as follows: placing rotating dampers with same silicone oil variety and same silicone oil quantity respectively at two ends of one side edge of a cover plate, and under the condition of different silicone oil reserves (the percentage of the volume of the silicone oil occupying the volume of the buffer space), performing test on the small angles of the rotating dampers, wherein the test result is as shown in table 1.

TABLE 1

Comparative Table of Silicone Oil Reserve and Use Small angles of Rotating Damper

| | Serial Number | | | | | | | | | |
|---|---|---|---|---|---|---|---|---|---|---|
| | 1 | 2 | 3 | 4 | 5 | 6 | 7 | 8 | 9 | 10 |
| Oil Reserve (%) | 77 | 80 | 85 | 90 | 92 | 93 | 94 | 95 | 96 | 97 |
| Small Angle (degree) | 30 | 29 | 26 | 20 | 18 | 17 | 16 | 16 | 15 | 15 |

It is known from table 1 that after the silicone oil reserve reaches 90% or above, the use small angle of the rotating damper is relatively small, which is less than 20 degrees, and therefore, the use scope of the rotating damper is extended.

In addition, small angle contrast experiment is performed on the damping assembly of embodiment 1, and the use small angles of the damping assemblies with same silicone oil variety and different silicone oil quantities are compared, wherein the comparison result is as shown in table 2.

TABLE 2

Comparative Table of Silicone Oil Reserve and Use Small angle of Rotating Damper

| | Embodiments | | | | | | | | |
|---|---|---|---|---|---|---|---|---|---|
| | Embodiment 1 | Embodiment 2 | Embodiment 3 | Embodiment 4 | Embodiment 5 | Embodiment 6 | Embodiment 7 | Embodiment 8 | Embodiment 9 |
| Oil reserve (%) | 90 | 90 | 92 | 94 | 95 | 96 | 97 | 85 | 80 |
| Small Angle (degree) | 18 | 18 | 15 | 13 | 12 | 10 | 8 | 21 | 25 |

It is known from table 2 that the use small angle of the damping assembly of the present invention is smaller under the actions of the silicone oil reserve and the assisting damper, and a function of retarding descending may be realized in a small angle of less than 20 degrees; even if in a condition that the silicone oil reserve is lower than 90%, the use small angle of the damping assembly is less than or equal to 25 degrees, indicating that the assisting damper may further reduce the use angle of the damping assembly.

2. Aiming at conditions of cover plates with different weights, compare the lightening proportion of the assisting damper to the weight of the cover plates.

The experiment process is as follows: respectively mounting the assisting damper and the rotating damper at two ends of one side edge of the cover plate, and testing the lightening proportion of the assisting damper to the weight of the cover plates in the descending process of the cover plates with different weights, wherein the test result is as shown in table 3.

TABLE 3

Table of Lightening Proportion of Assisting Damper to Weight of Cover Plate

| | Serial Number | | | | |
|---|---|---|---|---|---|
| | 1 | 2 | 3 | 4 | 5 |
| Weight of Cover Plate (Kg) | 1.6 | 1.9 | 2.1 | 3.3 | 4.6 |
| Weight of Cover Plate Lightened by Assisting Damper | 0.96 | 1.27 | 1.47 | 2.34 | 3.22 |
| Lightening Proportion of Assisting Damper to Weight of Cover Plate (%) | 60 | 67 | 70 | 70 | 70 |

It is known from table 3 that in the descending process of different cover plates, because the assisting damper provides an acting force opposite to the descending direction of the cover plate, which is equivalent to lightening of the weight of the cover plates, the torsion value of the rotating damper may be reduced, and therefore, the viscosity of the silicone oil in the rotating damper is reduced; and if the silicone oil with lower viscosity is used, the fluidity of the silicone oil inside is better, and the degree of the small angle is easier to reduce; under the assistance of the assisting damper, the whole damper assembly may realize the function of retarding descending with a smaller small angle.

The foregoing embodiments only describe several implementation manners of the present invention, and the description is specific and detailed, but cannot therefore be understood as a limitation to the patent scope of the present invention. It should be noted that a person of ordinary skill in the art may further make several variations and improvements without departing from the conception of the present invention, and all these fall within the protection scope of the present invention. Therefore, the patent protection scope of the present invention should be subject to the appended claims.

What is claimed is:

1. An assisting damper, characterized by comprising a shell I (1), a pin roll (2), a driving shaft (3), a driven shaft (4) and a spring assembly (5), wherein a damper working chamber (11) is arranged in the shell I (1), one end of the pin roll (2) penetrates out of a head end (111) of the damper working chamber (11), the other end is fixed with one end of the driving shaft (3), the other end of the driving shaft (3) is in contact with one end of the driven shaft (4), spiral cam structures matched with each other are respectively provided on the contact surfaces of the driving shaft (3) and the driven shaft (4), the other end of the driven shaft (4) is connected with one end of the spring assembly (5), the shape of a base (41) of the driven shaft (4) is matched with the shape of the longitudinal section of the damper working chamber (11), the base (41) does not rotate in the damper working chamber (11), the other end of the spring assembly (5) is in contact with a tail end (112), opposite to the head end (111), of the damper working chamber (11); the driving shaft (3), the driven shaft (4) and the spring assembly (5) are all located in the damper working chamber (11), and when the driving shaft (3) rotates, the driven shaft (4) is driven to translate along the length direction of the damper working chamber (11).

2. The assisting damper according to claim 1, characterized in that a tail plug (6) is provided at the tail end of the damper working chamber (11), and one end, close to the spring assembly (5), of the tail plug (6) is in contact with the spring assembly (5).

3. The assisting damper according to claim 2, characterized in that the spring assembly (5) comprises a first spring (51) and a second spring (52), the first spring (51) and the second spring (52) are sequentially arranged, the outer diameter of the first spring (51) is the same as the outer diameter of the second spring (52), one end of the first spring (51) is mounted on the driven shaft (4), the other end is in contact with one end of the second spring (52), and the other end of the second spring (52) is in contact with the inner wall of the tail plug (6).

4. The assisting damper according to claim 1, characterized in that the head end (111) of the damper working chamber (11) is provided with a shaft sleeve (7) and an end cover (8), one end of the shaft sleeve (7) is located on the inner wall of the head end (111) of the damper working chamber (11), the other end is located outside the head end (111), the end cover (8) is located on the outer wall of the head end (111) of the damper working chamber (11), the inner wall of the end cover (8) is in matched connection with the outer wall of the shaft sleeve (7), extending out of the head end (111), of the shaft sleeve (7), and one end of the pin roll (2) sequentially passes through the shaft sleeve (7) and the end cover (8) and then extends out of the shell I (1).

5. The assisting damper according to claim 4, characterized in that the spring assembly (5) comprises a third spring (53) and a fourth spring (54), the diameter of the third spring (53) is greater than the diameter of the fourth spring (54), the spiral direction of the third spring (53) is opposite to the spiral direction of the fourth spring (54), the third spring (53) is mounted on the outer side of the driven shaft (4), and the fourth spring (54) is mounted on the inner side of the driven shaft (4).

6. The assisting damper according to claim 1, characterized in that the driving shaft (3) comprises a first helicoid (31) and a second helicoid (32), a round hole (33) is formed in the center of one end, far away from the pin roll (2), of the driving shaft (3), and the first helicoid (31) and the second helicoid (32) are respectively located at the periphery of the round hole (33);

the driven shaft (4) further comprises a round shaft (42), a third helicoid (43) and a fourth helicoid (44), the round shaft (42) is provided at the center of the base (41), the third helicoid (43) and the fourth helicoid (44) are respectively located at the periphery of the round shaft (42), the round shaft (42) is matched with the round hole (33), and the third helicoid (43) and the fourth helicoid (44) are mutually matched with the first helicoid (31) and the second helicoid (32).

7. A damping assembly, characterized by comprising the assisting damper (100) of claim 1 and a rotating damper (200), wherein the assisting damper (100) and the rotating damper (200) are both mounted on a cover plate (300).

8. The damping assembly according to claim 7, characterized in that the rotating damper (200) comprises a shell II (210), a rotating shaft mechanism (220), an upper cover (230), a sealing member (240), two vanes (250) and two choke plates (260), wherein the shell II (210) comprises a containing cavity (211), the rotating shaft mechanism (220) is arranged in the containing cavity (211), the rotating shaft mechanism (220) and the upper cover (230) are sealed by the sealing member (240), a pair of rib sites (211*a*) are axially and symmetrically provided on the inner wall of the containing cavity (211), the two vanes (250) are axially and symmetrically provided on the rotating shaft mechanism (220), the choke plates (260) are provided in the vanes (250), the vanes (250) are arranged with the rib sites (211*a*), a viscous fluid is filled in a buffer space of the containing cavity (211), the rotating shaft mechanism (220) comprises a rotating shaft (221) and a flat site II (222), the flat site II (222) is connected with one end of the rotating shaft (221), the flat site II (222) is located outside the shell II (210), and the cross section of the rotating shaft (221) is formed by two segments of parabolas and two recesses.

9. The damping assembly according to claim 8, characterized in that the rotating shaft mechanism (220) further comprises two bosses (223), the rotating shaft (221) is axially and symmetrically provided with the two bosses (223), the vanes (250) are arranged on the bosses (223), a groove is formed in the middle of each vane (250), and the choke plates (260) are arranged in the grooves; and the viscous fluid is silicone oil.

10. The damping assembly according to claim 9, characterized in that the volume of the viscous fluid occupies 90-97% of the volume of the buffer space of the containing cavity (211).

11. A cover plate device, characterized by comprising the damping assembly of claim 7, the cover plate (300), and a support plate (400), wherein the cover plate (300) is located at the upper part of the support plate (400), the damping assembly is provided on one side edge of the cover plate (300), and the assisting damper (100) and the rotating damper (200) are respectively connected with a support shaft (410) on the support plate (400), so that the cover plate (300) is rotatably connected with the support plate (400).

* * * * *